US005911828A

United States Patent [19]

Curran

[11] Patent Number: 5,911,828

[45] **Date of Patent: *Jun. 15, 1999**

[54] CONDENSER TUBE COATING SYSTEM

[76] Inventor: Ed Curran, 830 S. North Lake Dr., Hollywood, Fla. 33019-1311

[ * ] Notice: This patent is subject to a terminal disclaimer.

[21] Appl. No.: 08/917,060

[22] Filed: Aug. 22, 1997

Related U.S. Application Data

[63] Continuation of application No. 08/682,425, Jul. 17, 1996, abandoned.

[51] Int. Cl.[6] ..... B05B 13/06; A62C 35/00

[52] U.S. Cl. ..... 118/306; 118/317; 118/DIG. 11; 137/355.18

[58] Field of Search ..... 118/DIG. 10, 215, 118/317, 306; 137/355.17–355.22; 451/76

[56] References Cited

U.S. PATENT DOCUMENTS

| | | | |
|---|---|---|---|
| 2,191,728 | 2/1940 | Purcell et al. | 118/215 |
| 2,679,434 | 5/1954 | Herrmann | 137/355.19 |
| 3,050,078 | 8/1962 | Hooper | 137/355.19 |
| 3,394,730 | 7/1968 | Sherman | 137/355.22 |
| 3,606,862 | 9/1971 | Huff et al. | 118/DIG. 10 |
| 3,939,862 | 2/1976 | Booth | 137/355.19 |
| 3,958,594 | 5/1976 | Masters | 137/355.17 |
| 4,216,738 | 8/1980 | Muta | 118/DIG. 10 |
| 4,368,091 | 1/1983 | Ontsuga et al. | 118/215 |
| 4,723,568 | 2/1988 | Adams | 137/355.17 |
| 4,838,302 | 6/1989 | Prange | 137/355.22 |
| 4,993,443 | 2/1991 | Buchert | 137/355.22 |
| 5,139,751 | 8/1992 | Mansfield et al. | 118/DIG. 10 |

*Primary Examiner*—David A. Simmons
*Assistant Examiner*—Calvin Padgett
*Attorney, Agent, or Firm*—Panitch Schwarze Jacobs & Nadel, P.C.

[57] ABSTRACT

A coating system for inner wall surfaces of tubes includes a hose reel and flexible hoses wound thereon. The hoses each carry an applicator nozzle through which the coating substance is dispensed. A payout guide assembly is disposed next to the reel for unwinding the hose and for feeding the nozzles into the tubes to be coated. The payout guide and the reel are also driven in reverse for removing the nozzles from the tube and winding the hoses on the reel. A high pressure paint spray system includes a paint pump assembly for supplying paint to the hose and a spray gun valve connected between the hose and the paint pumped assembly. A control system is connected to the payout guide, to the hose reel and to the spray gun valve, the control system coordinating the feeding and removing of the hose into and from the tube, as well as the paint application through the spray gun valve and the applicator nozzle.

8 Claims, 2 Drawing Sheets

CONDENSER TUBE COATING SYSTEM

This is a continuation of application Ser. No. 08/682,425, filed Jul. 17, 1996, now abandoned.

BACKGROUND OF THE INVENTION

1. Field of the Invention

The invention relates to an assembly for feeding and automatically distributing a substance on the inside of tubes and pipes, and more particularly to a system for semi-automatically coating and painting the inner wall surfaces of tubes in heat exchanger and condenser tube arrays.

Tubes and pipes are naturally quite inaccessible with regard to their inner wall surfaces. The surfaces are usually coated by immersing the tube into a liquid bath and rotating the tube. These procedures are not available when the tube is integrated in a heat exchanger array or the like. Condensers in power plants, for instance, often have tube arrays with hundreds of parallel and closely spaced pipes. These pipes are accessible only from the header or footer plates.

Condenser tubes are subject to extreme heat differentials, to corrosive media, and to solids deposits. During service, the tube walls are slowly abraded and deposits form thereon. The inner wall surfaces must therefore be cleaned from time to time and the protective coating on the inner wall surface must be refurnished.

SUMMARY OF THE INVENTION

It is accordingly an object of the invention to provide a condenser tube coating system, which overcomes the disadvantages of the prior art devices and methods and which allows quick and accurate application of coating material to the inner wall surface of a tube, and particularly to a multiple tube array. It is a further object of the invention to provide a system which can be converted with only simple means to an assembly for sandblasting (abrasive cleaning) the inner wall surfaces of tubes.

With the foregoing and other objects in view there is provided, in accordance with the invention, an integrated system for coating inner wall surfaces of tubes, comprising:

a hose reel and flexible hose wound on the reel, the hose carrying an applicator nozzle at a forward end thereof;

a payout guide assembly disposed spaced apart from the hose reel for unwinding the hose from the hose reel and for feeding the applicator nozzle into a tube to be coated, and for removing the applicator nozzle from the tube and returning the hose to the hose reel;

a high pressure paint spray system communicating with the hose, the paint spray system including a paint pump assembly for supplying paint to the hose and a spray gun valve connected between the hose and the paint pump assembly; and a control system connected to the payout guide assembly, to the hose reel and to the spray gun valve of the high pressure paint spray system, the control system coordinating the feeding and removing of the hose into and from the tube and the paint application through the spray gun valve and the applicator nozzle.

In accordance with an added feature of the invention, the payout guide assembly includes a motor and a driven roller driven by the motor, and a clamp roller for clamping the hose onto the driven roller.

Also, a reel motor may be connected to for driving the reel and as a reel brake. Accordingly, the reel motor is connected so as to act as a reel brake and for driving the reel when the hose is withdrawn from the tube.

In accordance with another feature of the invention, the control system is a pneumatic control system including an air compressor and pneumatic valves, the motors are air-driven motors, and the control system is pneumatically connected to the motors and to the spray gun valve.

In accordance with a further feature of the invention, the system comprises a pressure relief valve connected to the spray gun valve, the pressure relief valve being connected so as to be closed while the spray gun valve is open and connects the paint pump assembly to the hose, and to be opened for pressure relief when the spray gun valve is closed.

In accordance with a concomitant feature of the invention, the above-noted hose is one of three hoses or more to be simultaneously paid out from the reel, each of the hoses carrying one of the applicator nozzles, and each of the hoses being connectible to the paint pump assembly through the spray gun valve.

Other features which are considered as characteristic for the invention are set forth in the appended claims. Although the invention is illustrated and described herein as embodied in a condenser tube cleaning system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
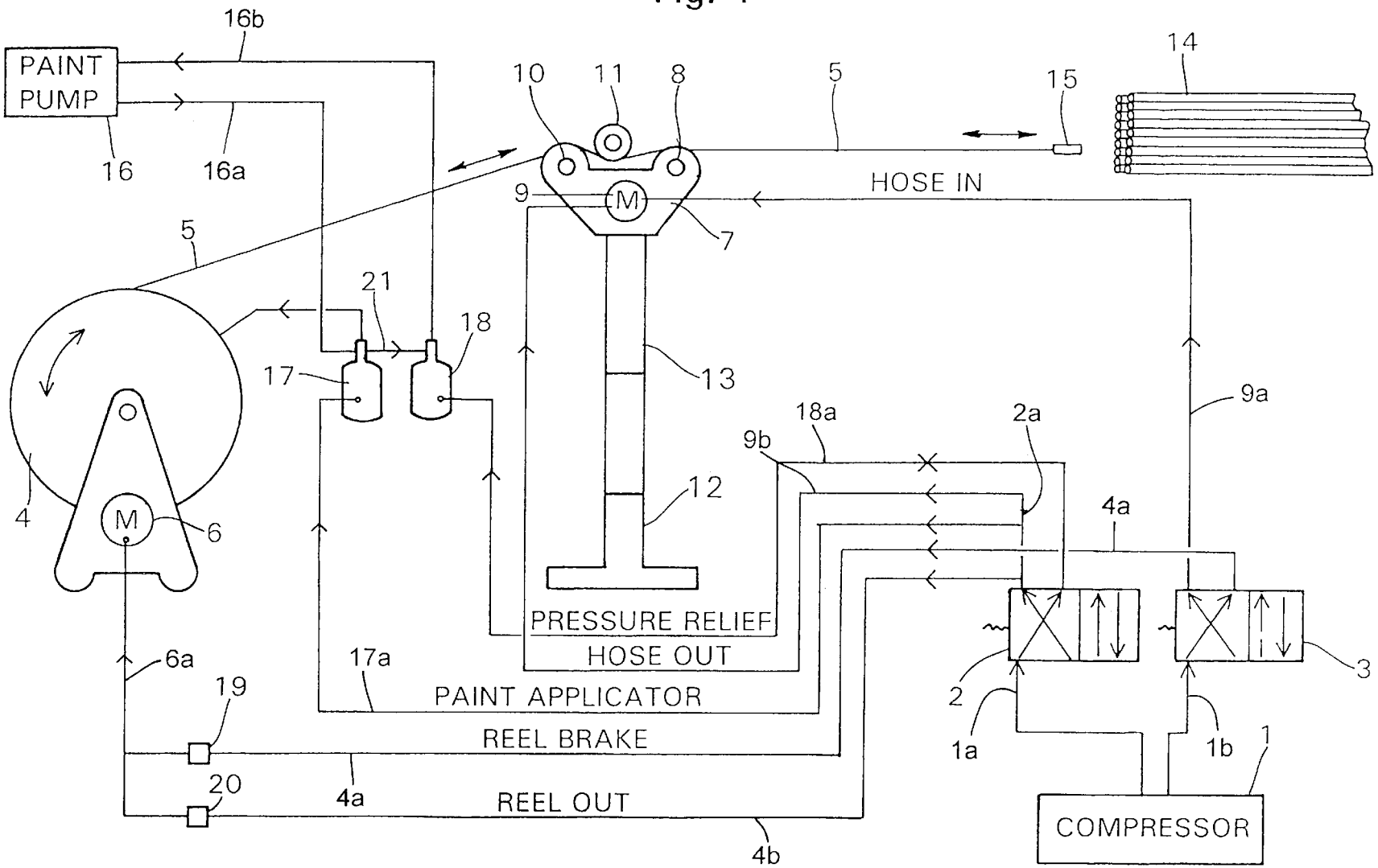
FIG. 1 is a diagrammatic illustration of the system of the invention.

Referring now to the figures of the drawing in detail and first, particularly, to the pneumatic diagram of FIG. 1 thereof, the system is supplied with pressurized air from an air compressor 1. The compressor 1 supplies constant pneumatic pressure of 6.8 atm (100 psi). A control system comprising a valve array (2, 3) formed with two air valves 2 and 3 connects the compressor 1 to the applicator system of the invention. The air valves 2 and 3 are substantially identically formed, foot-pedal operated valves. As will become clear from the following description, the valve 3 is connected so as to effect the insertion of the applicator nozzles into the tubes and the valve 2 is connected so as to effect the withdrawal of the applicator nozzles and the simultaneous spray coating of the tube walls.

A rotatably supported hose reel 4 holds a defined length of paint spray hose 5. In the preferred embodiment, the reel 4 is defined with three segments which each hold the same amount of hose 5. Accordingly, three hoses 5 are simultaneously paid out from the reel 4. The reel 4 is driven by an air motor 6, which is pneumatically connected to both valves 2 and 3. It should be understood that the reel 4 may also be driven manually or with an electrical motor.

The hose 5 is paid out from the reel 4 to a pay-out guide 7 which, in structure, is similarly constructed with a wire measurer. A forward roller 8 of the pay-out guide 7 is driven with an air motor 9, which effects the paying-out of the hose 5. The hose 5 is thereby clamped between the driven forward roller 8 and a rearward roller 10 on the one hand, and a clamping roller 11 on the other hand. The clamping roller 11 is preferably biased downwardly with a non-illustrated spring. The pay-out guide 7 is supported on a stand 12 with a telescoping column 13. The latter allows quick height adjustments so as to assure that the guide 7 feeds the hose into a respective condenser tube 14 approximately horizontally.

The forward tip of the hose 5 is provided with an applicator nozzle and check-valve 15, which will be explained in more detail in the following text.

An airless paint applicator system includes a paint pump 16 connected to the hose 5 through a high-pressure spray gun valve 17 and a pressure relief valve 18, and through a non-illustrated manifold inside the reel 4. A first fluid conduit extends from the paint pump 16 to the spray gun valve 17. A second fluid conduit 16*b* extends from the pressure relief valve 18 to the paint pump 16. The airless pressure system is thus independent of the pneumatic loop which includes the compressor 1, the valves 2, 3, and the motors 6, 9. First and second air conduits 1*a*, 1*b* extend from the compressor to the valves 2 and 3, respectively, to supply the valves 2 and 3 with a source of compressed air.

Referring now more particularly to the pneumatic loop system, all of the lines in the preferred embodiment are ⅜ lines. The valve 3, as noted above, is the in-valve. For that purpose, the valve 3 connects to the motor 9 via first motor air hose 9*a* for driving the roller 8 forward (clockwise as shown). Upon the actuation of a foot pedal (not shown) of the valve 3, to move the valve 3 to the left of the position shown in FIG. 1 to align the schematically shown vertically extending parallel conduits in the valve 3 with the first motor air hose 9*a* and the reel brake air hose 4*a* to thereby supply compressed air to the first motor air hose 9*a* and exhaust air from the reel brake air hose 4*a* such that the roller 8 is driven by the motor 9 and hose 5 is paid out from the reel 4. The reel brake air hose 4*a* is in fluid communication with the motor 6 via common motor hose 6*a*. In the pay-out position of the valve 3 the reel 4 is free to rotate and the hose 5 is essentially pulled from the reel by the roller 8.

When the foot pedal of the valve 3 is released to the position shown in FIG. 1, air is supplied to the motor 6 which acts as a brake via the reel brake air hose 4*a* and common motor hose 6*a* while exhausting air from the first motor air hose 9*a*. In other words, the reel brake prevents extra hose 5 from being paid out once the applicator nozzle 15 has reached the other side of the tube or the defined payout length has been attained. The strength of the reel brake is adjusted at a valve 19, which defines the amount of air allowed through the respective line and thus the effective brake power of the motor 6.

Once the required length of the hose 5, i.e. the hoses 5, has been paid out and the reel 4 has come to a stop, the system is ready for coating application. At that point, the valve 2 is actuated by depressing its foot pedal (not shown) to move the valve 2 to the left of the position shown in FIG. 1 to align the schematically shown vertically extending parallel conduits in the valve 2 with a common conduit 2*a* that is in fluid communication a second motor air hose 9*b*, a paint applicator air hose 17*a* and a reel out air hose 4*b* to thereby supply compressed air to the second motor air hose 9*b*, the paint applicator air hose 17*a* and the reel out air hose 4*b*. The reel out air hose 4*b* is in fluid communication with the motor 6 via the common motor hose 6*a*. This causes the motor 9 to reverse its direction and pull the hose 5 from the tubes 14. The motor 6 is actuated at the same time, so as to wind the hose 5 back onto the reel 4, and the paint applicator spray gun valve 17 is triggered. Paint from the paint pump 16 is thereby dispensed through the hose 5 and the applicator nozzle 15. The necessary pulling power of the motor 6 may be adjusted at a valve 20. In the preferred embodiment, the valve 19 is adjusted so that the motor 6 runs at about 0.4 kW (0.5 hp) and the valve 20 (together with the continuous feed through the valve 19) allows full power of approximately 3 kW (4 hp).

The hoses 5 are preferably marked with delimiters which allow the operator to quite accurately anticipate when the applicator nozzle is about to be pulled from the tube 14. At that point the valve 2 is released and moves to the right into the position shown in FIG. 1 to align the schematically shown vertically extending criss-crossed conduits in the valve 2 such that the air within the common conduit 2*a* is exhausted and compressed air is supplied to the pressure relief hose 18*a*. Thus, the forced flow to the motor 6 (through 20), to the spray gun valve 17, and to the motor 9 is stopped. Due to the pressure build-up in the paint loop up to several thousand psi (4000 psi in the preferred embodiment)—the flexible hoses 5 expand slightly during paint application, for example—it is necessary to immediately vent the same. This is effected by closing the pressure relief valve 18, by application of the compressed air through the pressure relief hose 18*a* which allows the overpressure and excess paint to bleed through a pressure relief jumper 21 and back to the paint pump 16 or a bleed container. This allows the pressure in the high-pressure paint loop to decrease very quickly until the check valve at the applicator nozzle 15 is closed. The result is minimal bleed of coating paint once the pedal at the valve 2 has been released.

The paint pump 16 may be chosen from any number of pumps which are commercially available. Applicant incorporated a 204 atm (3000 psi) 30:1 ratio pump available from GRACO, Inc. of Minneapolis, Minn. in the preferred embodiment.

Figure 2:
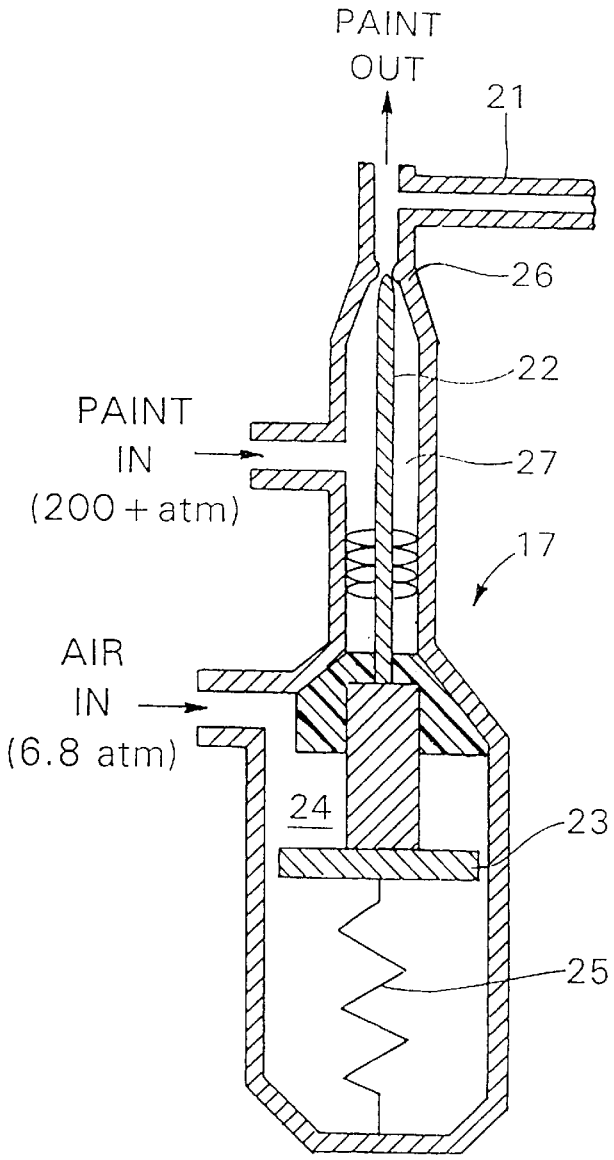
FIG. 2 is a sectional view of a high-pressure spray gun valve.

The spray gun and pressure relief valves 17 and 18 may be identical and are rated 270 atm (4000 psi). They are available, for instance, under the trademark AutoJet®. Referring to FIG. 2, which illustrates such an air-operated automatic spray gun valve, a valve needle 22 is actuated by a pneumatically operated piston 23. The piston 23 is thereby subjected to the pressure of the pneumatic loop when the valve 2 is triggered. Pressurized air enters a cylinder chamber 24 and forces the piston 23 downwardly against the force of a biasing spring 25. As the volume in the cylinder chamber 24 increases and the piston 23 moves downwardly (in the reference frame of FIG. 2), the valve needle 22 is lifted from a valve seat 26 at its forward tip. Coating material, i.e. the paint, which is forced into a needle chamber 27 from the paint pump 16, issues at a spray tip 28 in a substantially atomized form. From the spray tip 28 the paint is forced through the armature at the reel 4 and into the hoses 5.

Figure 3:
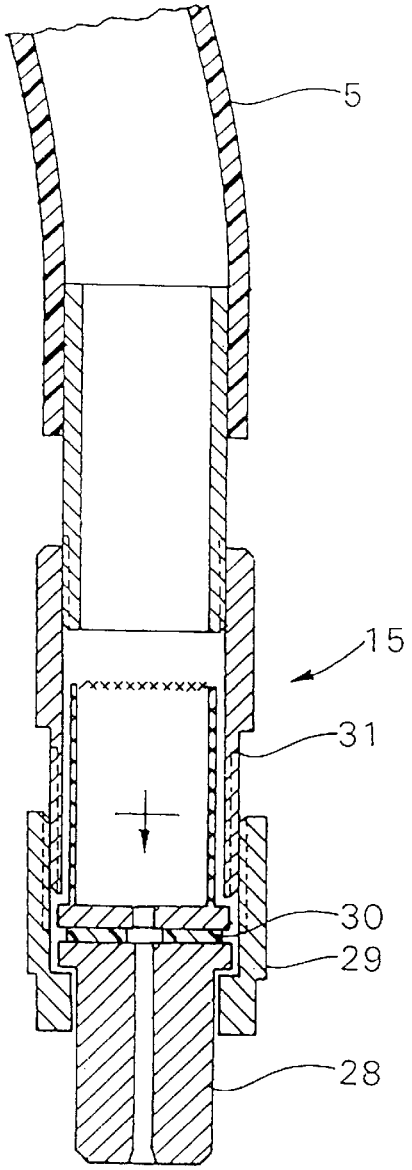
FIG. 3 is a sectional view of an applicator nozzle.

At the tip of each of the hoses 5 there is provided a paint spray applicator nozzle 15, which is formed with a spray nozzle and a check valve. With reference to FIG. 3, the hose 5 is tightly connected to the applicator tip 15, which includes a spray tip 28, a high-pressure tip retainer 29, a tip gasket 30, a strainer 31, and other non-essential connectors. A check valve is built into the strainer 28. The check valve of the preferred embodiment is rated at about 2.4 atm (40 psi), which ensures quick shutoff of the paint application, i.e. only minimal afterflow. The applicator system is commercially available, for instance under the trademark UniJet®.

A basic reel assembly 4,6 is commercially available from Reelcraft Industries, Inc. of Columbia City, Ind. The reel 4, as mentioned above, may be driven electrically, pneumatically, or by means of a hand crank. The preferred embodiment, however, uses an air-driven motor 6. While the commercially available reel is available only for a single hose, i.e. with a single hose connector, it is understood that the armature must be branched so as to allow connection of as many hoses as required. The preferred embodiment of the invention has been tested as a triple-hose system. The hose connector assembly at the reel thus was branched into three connectors with a triple tee branch and the spool cylinder was divided with two divider vanes.

The air motors 6 and 9 are commercially available from GAST. The air motor 6 may also be purchased together with the reel 4.

It should be understood that the system which has been illustrated and described herein can be converted to a sandblasting system for cleaning the tubes by removing deposits and corrosive blisters. The pneumatic loop remains the same. The high-pressure paint loop is thereby replaced with a sandblasting loop (low pressure of not more than 20 atm) and the applicator nozzle 15 is replaced with a sandblasting tip.

I claim:

1. An integrated system for coating an inner wall surface of a tube, the system comprising:

a flexible hose having an applicator nozzle attached at a forward end thereof;

a payout guide drivingly engaged with the hose for driving the hose and the applicator nozzle into and through the tube and removing the hose and the applicator nozzle from the tube;

a fluid supply system attached to the hose, the fluid supply system including a fluid source supplying a fluid to the hose and applicator nozzle, a supply valve interposed between the fluid source and the applicator nozzle for selectively applying the supplied fluid to the applicator nozzle, and a pressure relief valve connected to the supply valve, the pressure relief valve being closed when the supply valve is in an open position and being open when the supply valve is in a closed position for relieving pressure from the fluid source; and a control system operatively connected to the payout guide for controlling the driving and removing of the hose and nozzle applicator and to the supply valve for controlling application of the supplied fluid to the applicator nozzle.

2. The system of claim 1 wherein the payout guide includes a payout motor and a payout device driven by the payout motor.

3. The system of claim 1 wherein the control system is a pneumatic control system including a pneumatic compressor in fluid communication with at least one pneumatic control valve the at least one pneumatic control valve being energized by the pneumatic compressor, wherein the payout motor is a pneumatically powered motor controlled by the at least one pneumatic control valve, and wherein the reel motor is a pneumatically powered motor controlled by the at least one pneumatic control valve.

4. The system of claim 1 further comprising a hose reel having the hose wound thereon, and a reel motor operatively connected to the hose reel for driving the hose reel.

5. The system of claim 4 wherein the control system is a pneumatic control system including a pneumatic compressor in fluid communication with at least one pneumatic control valve, the at least one pneumatic control valve being energized by the pneumatic compressor, and wherein the reel motor is a pneumatically powered motor controlled by the at least one pneumatic control valve.

6. The system of claim 4 wherein the reel motor drives the hose reel during the removing of the hose and nozzle.

7. The system of claim 4 wherein the reel motor brakes the hose reel.

8. The system of claim 1 wherein the payout guide has a vertical position adjustment mechanism for adjusting a vertical position of the payout guide, whereby the payout guide is alignable with tubes located at different vertical heights.

* * * * *